US010934739B1

(12) United States Patent
Vazquez et al.

(10) Patent No.: US 10,934,739 B1
(45) Date of Patent: Mar. 2, 2021

(54) MODULAR CANOPY STRUCTURE

(71) Applicants: Jorge Vazquez, Port Arthur, TX (US); Jorge Vazquez, Jr., Port Arthur, TX (US); Carlos Martinez, Port Arthur, TX (US)

(72) Inventors: Jorge Vazquez, Port Arthur, TX (US); Jorge Vazquez, Jr., Port Arthur, TX (US); Carlos Martinez, Port Arthur, TX (US)

( * ) Notice: Subject to any disclaimer, the term of this patent is extended or adjusted under 35 U.S.C. 154(b) by 0 days.

(21) Appl. No.: 16/799,621

(22) Filed: Feb. 24, 2020

Related U.S. Application Data

(60) Provisional application No. 62/965,300, filed on Jan. 24, 2020.

(51) Int. Cl.

| | |
|---|---|
| ***E04H 15/18*** | (2006.01) |
| ***E04H 15/44*** | (2006.01) |
| ***E04H 15/64*** | (2006.01) |
| ***E04H 15/62*** | (2006.01) |
| ***E04H 15/58*** | (2006.01) |
| ***E04H 15/54*** | (2006.01) |

(52) U.S. Cl.
CPC ..... *E04H 15/44* (2013.01); *E04H 15/18* (2013.01); *E04H 15/54* (2013.01); *E04H 15/58* (2013.01); *E04H 15/62* (2013.01); *E04H 15/64* (2013.01)

(58) Field of Classification Search
CPC ..... E04H 15/18
See application file for complete search history.

(56) References Cited

U.S. PATENT DOCUMENTS 1,648,724 A * 11/1927 Dakin ..... E04G 21/28 52/63
3,121,470 A * 2/1964 Stone ..... G09F 19/226 182/129
3,399,889 A * 9/1968 Harry ..... E04H 15/58 473/481
3,690,078 A * 9/1972 Maynard, Jr. ..... E04B 1/1903 135/137
3,805,816 A * 4/1974 Nolte ..... B66C 1/10 135/115

(Continued)

*Primary Examiner* — Noah Chandler Hawk
(74) *Attorney, Agent, or Firm* — Nolte Lackenbach Siegel

(57) ABSTRACT

A modular canopy structure is disclosed. The modular canopy structure may utilize component parts of industry standard scaffolding portions attached to a specifically designed bow beam (roof support portion). The bow beam mates with industry standard scaffolding portions that form a side wall of the canopy structure. Construction of the canopy structure (e.g., on-site assembly) is simplified over prior art temporary structures and the disclosed canopy structure provides strength and near 100% water resistance as well as other improvements based, in part, on sidewall sleeves, overlapping techniques, material usage, and other design considerations. In some cases, the disclosed canopy structure may be suitable for onsite construction projects (including welding), temporary housing in a disaster, or as a suitable temporary to semi-permanent structure for outdoor events (e.g., wedding, party, temporary building). The disclosed modular canopy structure provides for functional windows and doors not available in prior art implementations.

20 Claims, 18 Drawing Sheets

(56) References Cited

U.S. PATENT DOCUMENTS

| | | | | | |
|---|---|---|---|---|---|
| 4,590,714 | A * | 5/1986 | Walker | B32B 27/12 | 250/585 |
| 4,798,220 | A * | 1/1989 | Smoljo | E04B 1/762 | 135/115 |
| 5,038,889 | A * | 8/1991 | Jankowski | E04G 5/12 | 182/129 |
| 5,450,703 | A * | 9/1995 | Fuhrman | E04H 15/18 | 135/114 |
| 5,884,647 | A * | 3/1999 | Dwek | E04H 15/52 | 135/144 |
| 9,447,601 | B2 * | 9/2016 | Maillis | E04H 15/505 | |
| 2003/0037812 | A1 * | 2/2003 | Stewart | A47K 3/286 | 135/96 |
| 2013/0276382 | A1 * | 10/2013 | Workman | E04B 1/34384 | 52/63 |

* cited by examiner

1700

MODULAR CANOPY STRUCTURE

CROSS-REFERENCE TO RELATED APPLICATIONS

This application claims priority to and benefit from U.S. Provisional Application Ser. No. 62/965,300, filed 24 Jan. 2020, and having the same title and inventorship as the instant application, which is hereby incorporated by reference in its entirety for all applicable purposes.

BACKGROUND

Temporary structures have many different uses. Some common uses for temporary structures include weather resistant job shacks; job site meeting areas; special events (e.g., wedding, party); and storage. Other uses are also possible with improvements to weather resistance and other operational parameters (e.g., fire resistance; wind stability).

BRIEF DESCRIPTION OF THE DRAWINGS

The present disclosure may be better understood from the following detailed description when read with the accompanying Figures. It is emphasized that, in accordance with standard practice in the industry, various features are not drawn to scale. In fact, the dimensions or locations of functional attributes may be relocated or combined based on design, security, performance, or other factors known in the art of computer systems. Further, order of processing may be altered for some functions, both internally and with respect to each other. That is, some functions may not require serial processing and therefore may be performed in an order different than shown or possibly in parallel with each other. For a detailed description of various examples, reference be made below to the accompanying drawings, in which.

DETAILED DESCRIPTION

Figure 1:
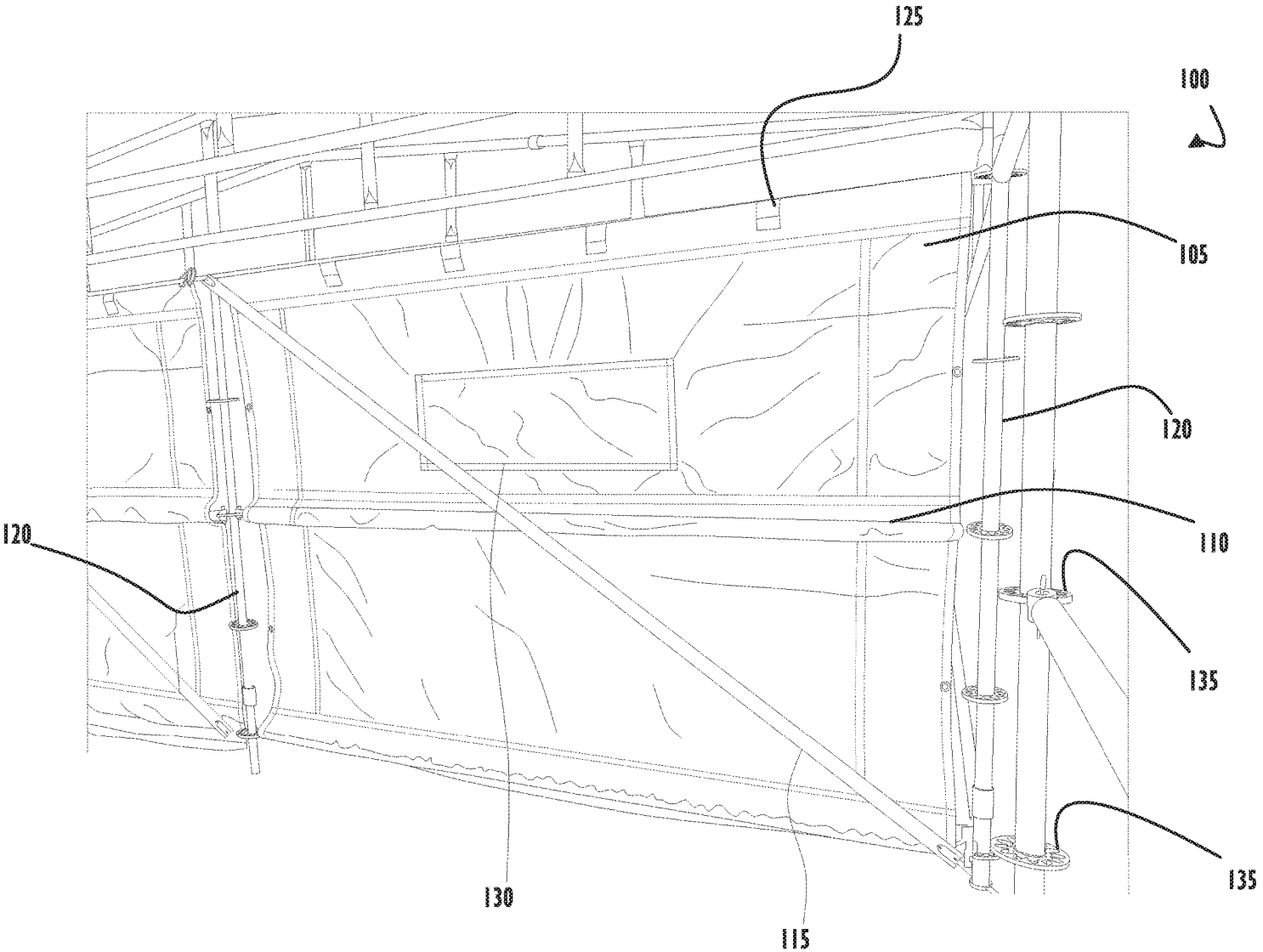
FIG. 1 illustrates a partially constructed side wall of a modular canopy structure, according to one or more disclosed implementations.

Illustrative examples of the subject matter claimed below will now be disclosed. In the interest of clarity, not all features of an actual implementation are described for every example implementation in this specification. It will be appreciated that in the development of any such actual example, numerous implementation-specific decisions may be made to achieve the developer's specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The disclosed modular canopy structures may provide improvements over previously available temporary structures by reducing assembly time and increasing stability and other operational parameters to create a temporary structure that more closely functions like a permanent structure.

In addition to the uses mentioned above, this disclosure provides for a temporary modular canopy structure that improves upon existing capabilities for a temporary building (e.g., a weather resistant canopy in accordance with this disclosure). The resultant structures are more efficient in terms of assembly cost (e.g., time and labor) and provide for structural improvements to allow for additional uses. Some of the additional uses of the disclosed modular canopy structure include insulation storage; insulation fabrication shop; weather protected welding, grinding and fabrication rooms; lunchrooms; weather protected material storage units; homeless shelters; emergency disaster response offices; and vehicle/equipment garages.

Disclosed implementations may utilize a fire resistant ("FR") fabric type material to create an outer shell. In some cases, the outer shell may include sleeve type "folds" to allow insertion of structural support members. Having an outer shell fabric type material may reduce construction time and improve portability of the disclosed modular canopy structure. The sleeve type folds may be sewed into place using an FR thread to further assist in flame retardance with respect to the overall structure. As a result, disclosed embodiments include implementations that may be useful for welding and other uses that may have an increased chance of creating a fire internal to the structure. Accordingly, disclosed techniques improve functionality of temporary structures, in part, because preventing of the outer shell from catching fire represents a benefit to increase the number of applicable uses for temporary structures.

Disclosed techniques to build modular canopy structures include use of readily available and industry standard scaffolding material. This industry standard scaffolding may be used to form walls of a temporary structure. To create a roof portion of the temporary structure, specifically designed bow beams are provided to mate to the wall elements (e.g., wall scaffolding sections). Further, stability and weather resistance may be improved by the fastening techniques used to attach an outer shell material (e.g., fabric like material) to the structure. In some cases, the outer shell material is attached while constructing the outer wall structure such that cross beams and possible vertical support elements may be sleeve attached as opposed to being attached with a common tie-down technique. By having a support member pass through a sleeve of the material, the resulting structural integrity of the modular canopy may be increased substantially.

Use of durable outer shell materials and improved structural integrity may allow for temporary structures in accordance with this disclosure to be used for long periods of time as opposed to previously available temporary structures. Also, because of the disclosed improved structural considerations, assembly time for the disclosed modular canopy may be reduced with respect to the time spent in the erection of previously available temporary structures. Accordingly, multiple benefits may be realized by using the disclosed modular canopy structure over that of previously available implementations.

Industry standard scaffolding material is strong, safe and durable (e.g., lasts for a long time outside in different weather conditions). Starting from this basic framework of scaffolding structure, other items that are unique to the disclosed construction implementations make the disclosed structures more flexible and usable than other available systems. The use of fire retardant industrial strength Vinyl (available in many colors) offers protection and shielding from flame, spark and high heat. In some implementations, gable vents, screened vinyl windows, emergency exit doors, sandbag anchors, and other options may provide different construction options.

Industry standard scaffolding components used to build the disclosed modular canopy structure may include at least one or more of a: scaffold jack, base collar, standards/verticals, clamp on leg assembly/spigot adaptor clamp, ledger/horizontal, diagonal braces/bay braces. Additionally, disclosed implementations may include one or more USAW trusses (roof beams) that are non-standard scaffolding components and fabricated as disclosed herein. In some implementations, a USAW truss may be fabricated in different sizes and shapes using a 0.65 16 gauge aluminum. Some examples sizes may be used to form the different size roof frames illustrated in FIGS. 18-20.

In some implementations, the outer shell fabric may be Advantage MVP 18 PVC coated polyester material having an appropriate strength and consistency for different applications. Other types of fabric type material may also be used. In any case, the fabric properties may allow for a modular canopy structure, built in accordance with this disclosure, to handle adverse weather conditions and withstand physical stress (e.g., from wind, rain, snow, falling objects, etc.). Use of Advantage MVP 18 PVC provides a useable strength while maintaining a soft and aesthetic appearance at an acceptable weight that performs well for easy assembly, fire retardance, and durability (e.g., can withstand environmental factors for outdoor applications).

Having the above overview, this discussion turns to the FIGs. to describe elements of standard scaffolding components as well as new components that may be used to construct the disclosed modular canopy structure. For clarity of presentation, not all elements are labeled with a reference number in each of the views. Where appropriate, reference numbers to elements are maintained throughout the FIGs. It is to be understood that some of the FIGs. disclosed partially constructed modular canopies that are not in an operational configuration. Specifically, some elements are shown in a non-operational implementation as those elements may not otherwise be visible in a view of a fully constructed structure. In any case, one of ordinary skill in the art, given the benefit of this disclosure, will understand that additional elements may be added, and some optional components may be removed from each FIG. without departing from the scope of this disclosure. For simplicity, vertical support members may be referred to in the singular as simply "vertical" or in the multiple as "verticals" and horizontal support members may be referred to in the singular as simply "horizontal" or in the multiple as "horizontals."

Referring now to FIG. 1, a partially constructed side wall 105 is illustrated in view 100, according to one or more disclosed implementations. View 100 is relative to an interior position of the partially constructed side wall 105 (e.g., as would be seen from the inside of a modular canopy structure). Also, in view 100, diagonal support 115 and sleeve fold 110 are illustrated. Although not visible in the picture (i.e., because each is inside a sleeve fold 110) multiple horizontal supports span between verticals 120. Access flap 125 illustrates a partial view of an upper horizontal inserted into a sleeve fold. Access flap 125 may be a connection point for roof beams (205 of FIG. 2) that may use spigot adaptor connectors as disclosed herein. Collars 135 illustrates a connection point between horizontal and vertical support members. This connection point represents a standard connection mechanism as may be used in scaffolding construction. As illustrated, not all collars 135 may be utilized in every construction of a modular canopy. View 100 also illustrates a window 130 that may be included to allow light or ventilation for a modular canopy structure.

Figure 2:
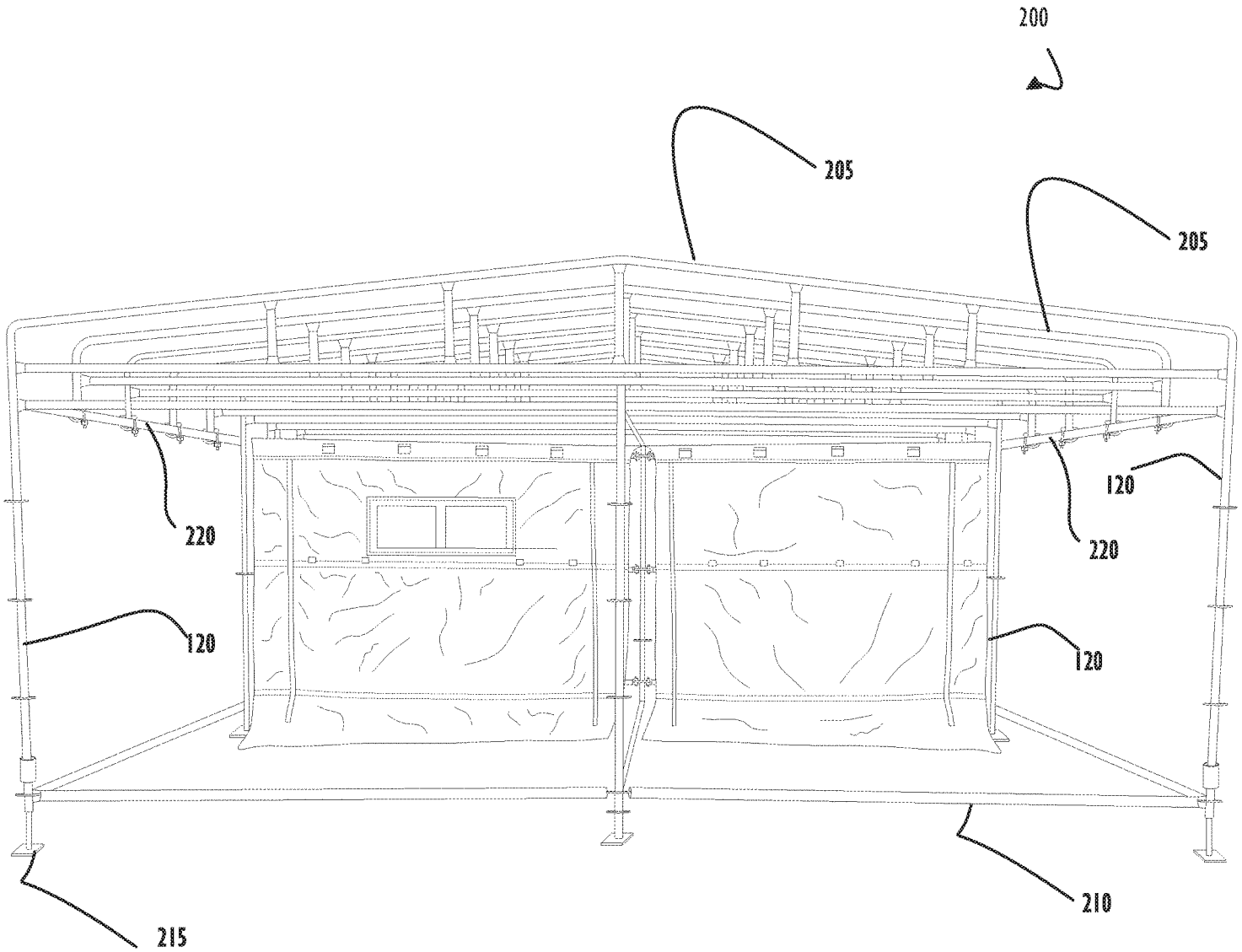
FIG. 2 illustrates a partially constructed frame including the partially constructed sidewall of FIG. 1, according to one or more disclosed implementations.

Referring now to FIG. 2, a view 200 illustrates a partially constructed frame, according to one or more disclosed implementations. View 200 illustrates multiple roof beams 205 connected (e.g., using a spigot adapter clamp) to upper horizontal supports 220. Multiple verticals 120 are also illustrated. At the base of each vertical 120 may be a screw jack 215 to allow for an adjustable base. For example, on uneven ground different screw jacks 215 may be set to different relative heights to allow for a substantially level frame implementation for the disclosed modular canopy structure. Lower horizontal 210 is illustrated as spanning between adjacent verticals 120.

As illustrated in view 200, each instance of a roof beam 205 spans above and across between two side walls and provides an angle for a roof of a modular canopy structure. The roof angle allows the roof to have a pitch. The pitch may allow, for example, rainwater to not collect on the roof portion. Roof beam 205 is not standard scaffold material and may be fabricated by adding (e.g., welding) a standard scaffold connector (e.g., adding a spigot adapter clamp) to a precision dimension roof beam. Roof beam 205 is illustrated and discussed in more detail below with reference to FIG. 11.

Figure 3:
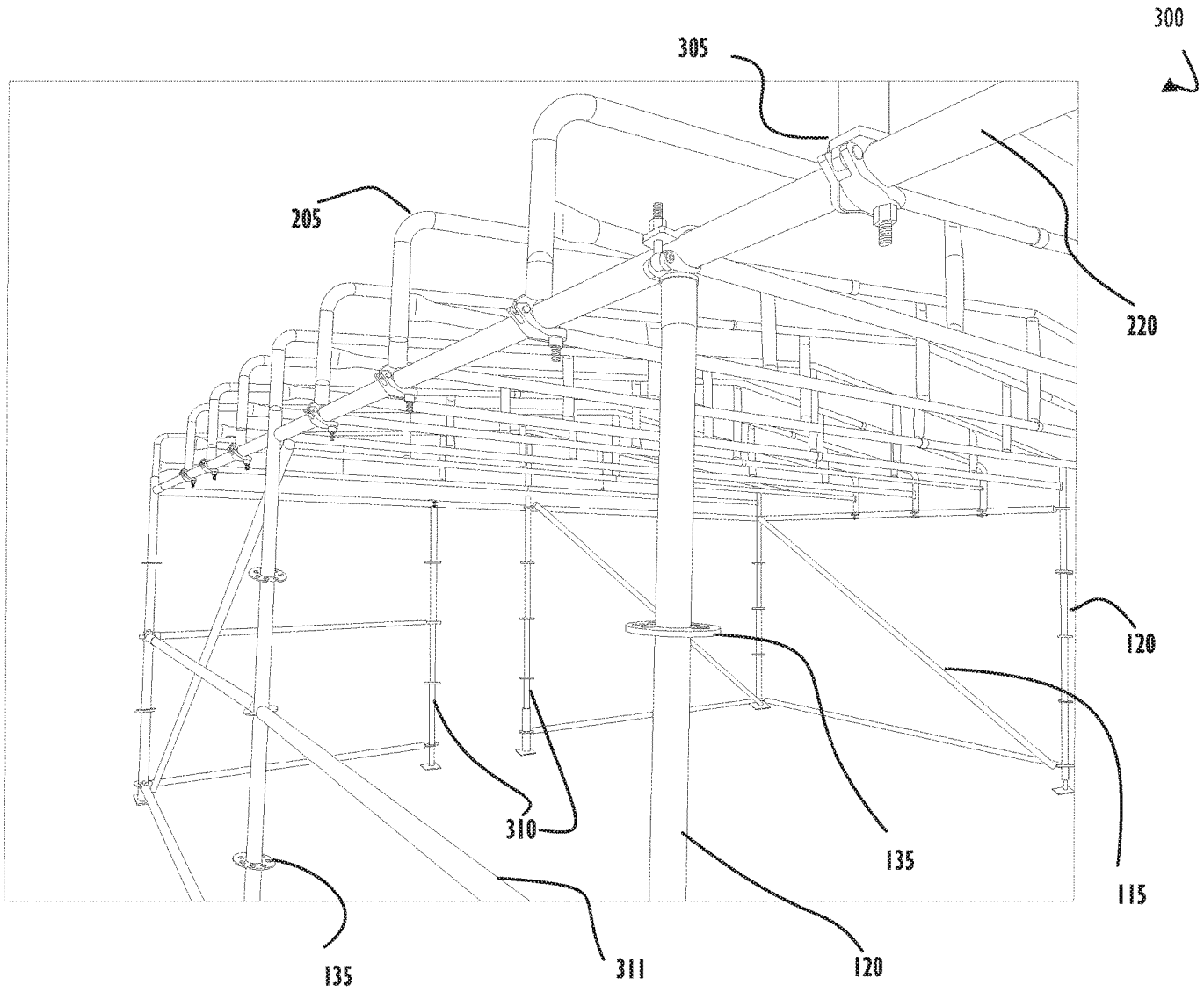
FIG. 3 illustrates a partially constructed upper wall to roof portion and side-frame with a door opening, according to one or more disclosed implementations.
Figure 11:
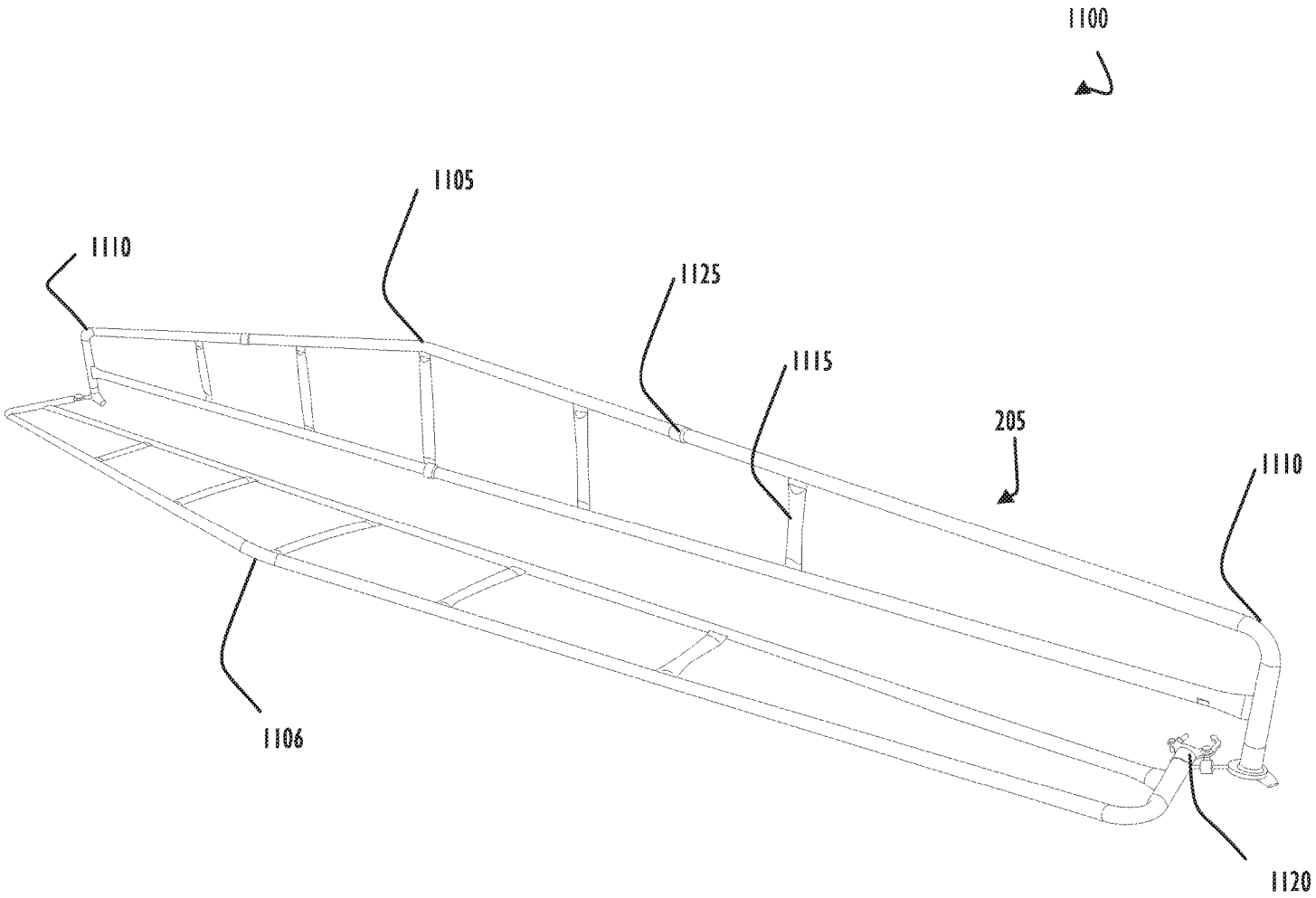
FIG. 11 illustrates a roof beam and a scaffolding connector of the roof-beam, according to one or more disclosed implementations.

Referring now to FIG. 3, view 300 illustrates a partially constructed upper wall to roof portion and a side-frame with door opening (illustrated between verticals 310), according to one or more disclosed implementations. In particular, view 300 illustrates multiple roof beams with scaffold connectors (one example is roof beam with scaffold connector 305 that may be a spigot adapter claim). In view 300 one example of an upper horizontal 220 has multiple scaffold connectors (i.e., in this example a spigot adaptor clamp) as identified by reference element 305. To be clear, roof beams 205 as disclosed herein are not to be considered standard scaffold material. Roof beams 205 do not exist within the scope of currently available scaffold material. FIG. 11 discussed below illustrates specific elements of roof beam 205.

View 300 includes elements shown in other FIGs. from different perspectives. Note that mid-horizontal 311 illustrates a single mid-point horizontal support for the modular canopy structure of view 300. In some implementations, there may be more than one instance of mid-horizontal 311. Depending on structural integrity requirements of a particular implementation, there will be exactly one lower horizontal 210 connected at or near the top of screw jacks 215, exactly one upper horizontal 220 to which roof beams 205 (and door verticals 310) will be attached, and one or more (one only in view 300) mid-horizontals 311 installed for a given modular canopy structure. As illustrated vertical supports at a corner may be considered to be a component of each adjacent side wall concurrently.

Figure 4:
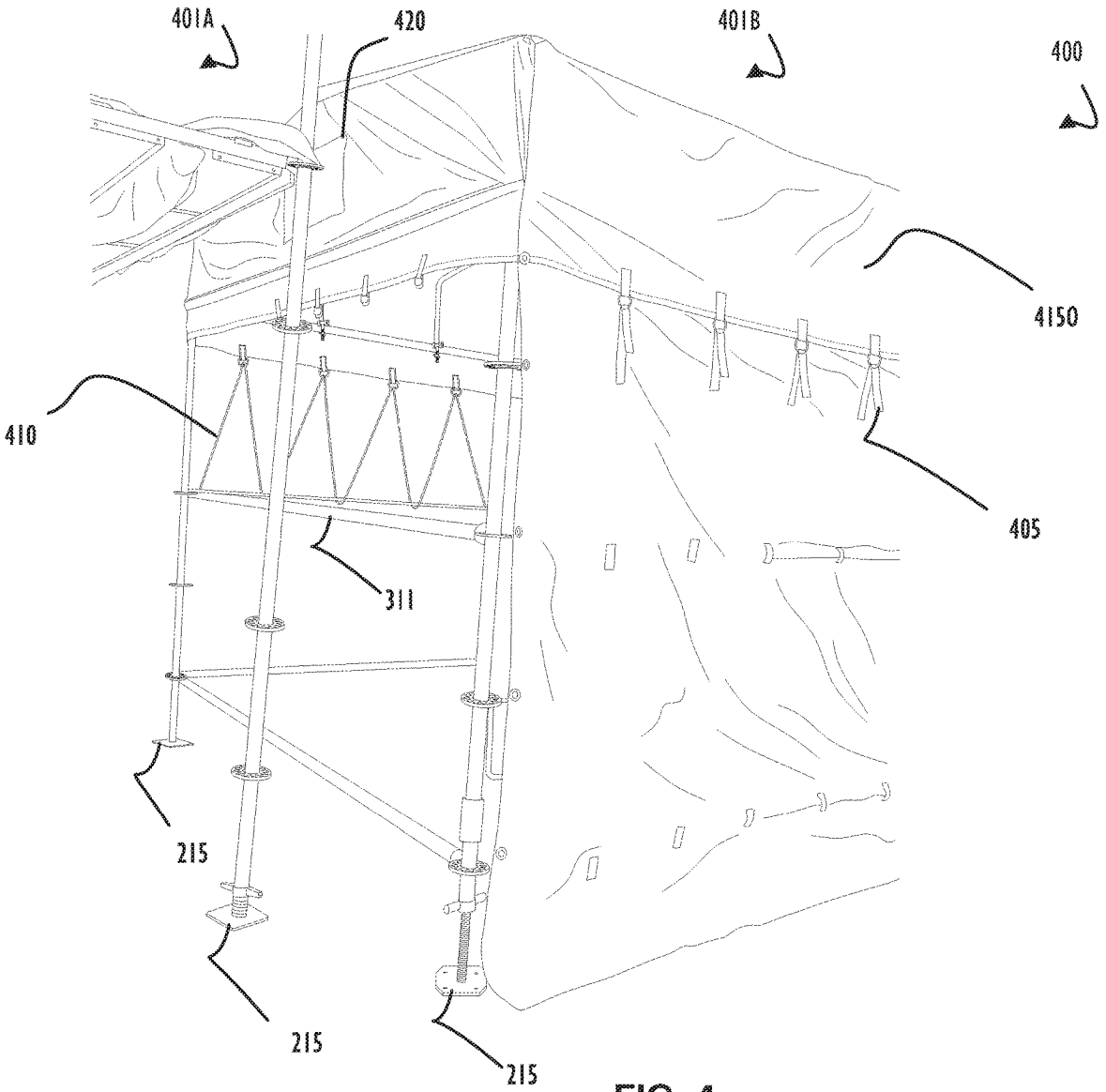
FIG. 4 illustrates a partially covered frame structure of two side-by-side canopies, according to one or more disclosed implementations.

Referring now to FIG. 4, view 400 shows a partially covered side wall for the frame structure similar to that of FIG. 3, according to one or more disclosed implementations. View 400 illustrates a partial view of two independent canopy structures. A portion of first canopy 401A is illustrated on the left side of view 400 and a second canopy structure 401B is illustrated on the right of first canopy 401A (note there is some overlap visible with respect to the two canopy structures). View 400 includes two visible verticals for second canopy structure 401B and a single vertical (i.e., a corner vertical) for first canopy structure 401A. Note that first canopy structure 401A does not yet have installed any mid-horizontals or a lower horizontal. In contrast, second canopy structure 401B includes a lower horizontal and mid-horizontal 311. Thus, view 400 illustrates a modular aspect of construction techniques that may be employed when building the disclosed modular canopy structure. Specifically, different elements may be installed in different orders and still result in a functional structure with high structural integrity. Order of installation of components may be determined at the time of assembly (obviously with a few necessary restrictions).

View 400 illustrates a roof vent 420 (e.g., gable vent) that may act in a similar manner to window 130 of FIG. 1. That is, roof vent 420 may be used to allow entry of light or provide ventilation to allow multiple types of internal activity (e.g., welding) to be performed within a fully constructed modular canopy structure. An outer shell covering for a roof may overlap with side-wall outer shell portions. Roof overlap 4150 illustrates an outer view of one example roof overlap for first canopy structure 410B. Strap fasteners 405 may be used to secure roof overlap 4150 to an adjacent (and overlapped) side-wall outer shell portion. Also, roof tie-downs 410 may be used to further secure a roof outer shell portion to a mid-point horizontal as illustrated in view 400. Use of both roof tie-downs 410 and strap fasteners 405 concurrently allows for an extremely tight connection and substantially weatherproof seal provided by the overlapping of outer shell portions of this disclosure. Specifically, the modular canopy structure, once completely assembled, may be very resistant to wind and rain because of overlapping and interconnecting features as disclosed herein. Roof tie-downs 410 may be positioned so as to allow securing an overlapping roof portions to grommets (e.g., an eyelet in a fabric creating an opening in the fabric where the opening is surrounded by metal, plastic or another similar material) at or about a sleeve fold of a side wall. Other positions for attachment points are possible, however, attaching a roof overlap at or near an internal horizontal that may be inserted through a sleeve fold may provide for a secure attachment point.

View 400 illustrates another example of screw jacks 215 that provide leveling aspects for each respective modular canopy. In view 400, each of screw jacks 215 is attached to a base collar of a corresponding vertical. Specifically, screw jacks 215 may be installed under the lowest base collar so that they rest on the ground and may be useful to level a modular canopy structure when desired (e.g., when constructed on uneven ground).

Figure 5:
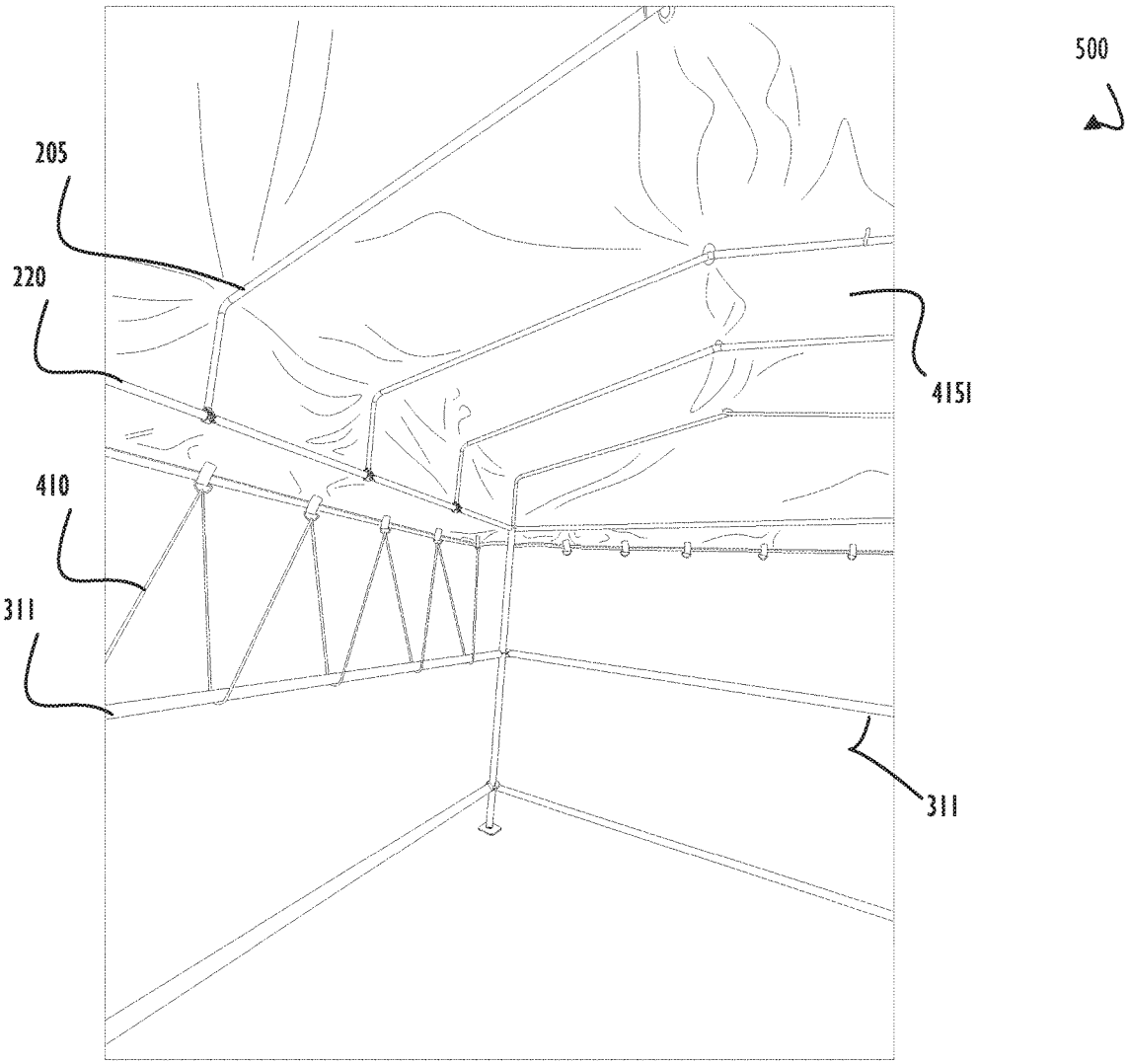
FIG. 5 illustrates an inner view (relative to a constructed structure) of a partially covered canopy structure, according to one or more disclosed implementations.

Referring now to FIG. 5, an inner view 500 of a partially covered canopy structure is illustrated, according to one or more disclosed implementations. View 500 illustrates an interior view of roof shell portion 4151. Another view of roof tie-downs 410 is illustrated as spanning between the portion of roof shell that overlaps below upper horizontal 220 and mid-horizontal 311. An outer seam in the fabric of the roof shell portion 4151 may include hooks, loops, grommets, or other suitable fastener point for roof tie-downs 410. Inner view 500 again illustrates roof beams 205 and their association with upper horizontal support members.

Figure 6:
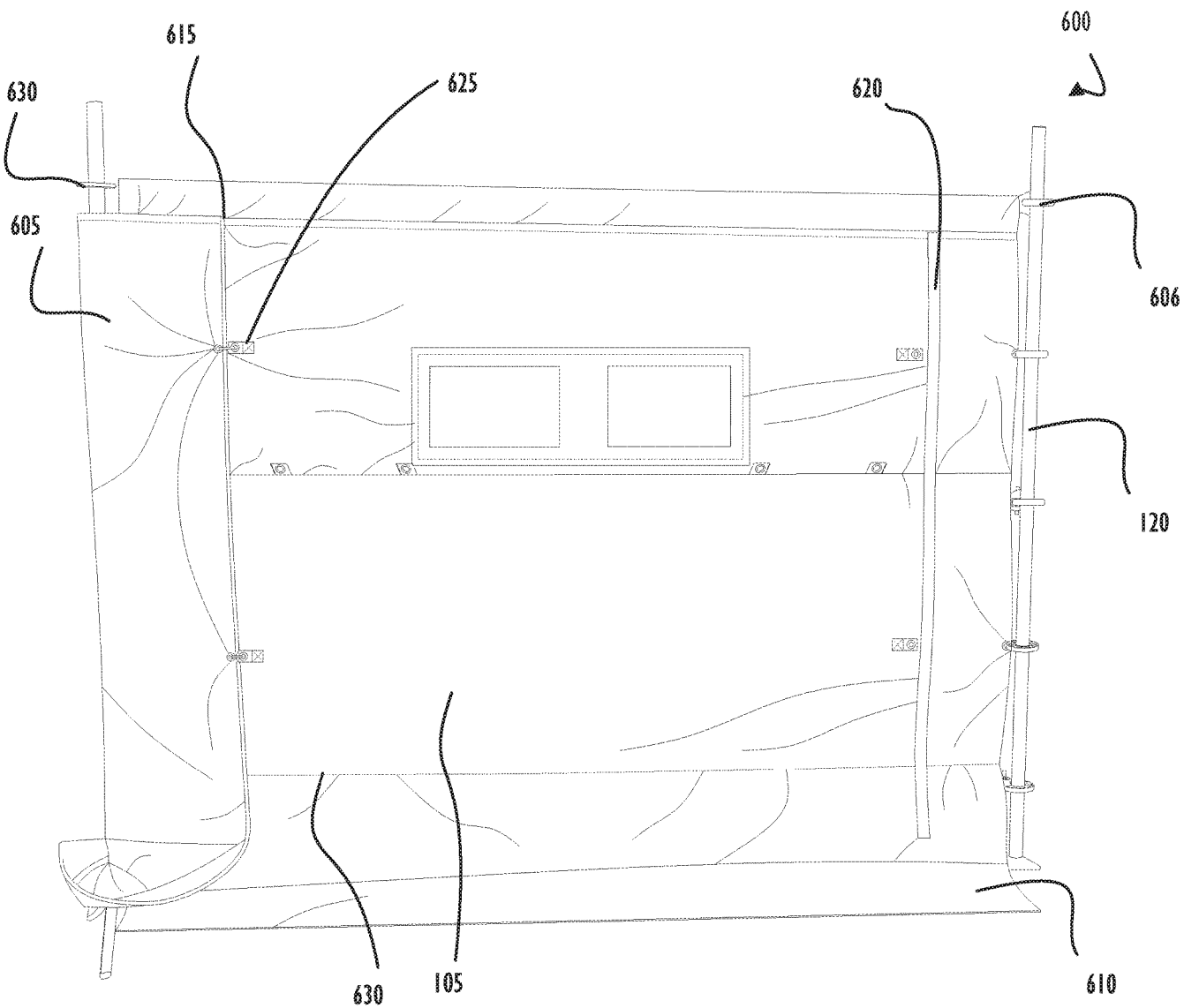
FIG. 6 illustrates an outer view to illustrate overlapping outer shell portions, according to one or more disclosed implementations.

Referring now to FIG. 6, view 600 illustrates an outer view of a side-wall having overlapped outer shell portions. Note that, in a similar manner to how roof outer shell portions overlap with side walls, each side wall outer shell portion 105 may wrap around and overlap with an adjacent side wall. Further, wall to ground overlap 610 illustrates that outer wall shell portions (e.g., 105) may extend onto the ground to further provide weather sealing aspects for the disclosed modular canopy structure.

As illustrated in view 600, vertical 120 includes multiple collars (e.g., collar 606). Each of the collars may be used to secure an initially installed side wall outer shell portion 105 (i.e., prior to having another outer wall shell portion for which to overlap) or may be used to connect a horizontal (e.g., mid-horizontal 311). View 600 illustrates a point 630 that shows outer wall shell portion 105 at a sleeve fold (discussed in more detail below). From an outside view of a modular canopy structure, point 630 may appear as a seam in outer wall shell portion 105. Outer wall shell portion 105 includes a wall overlap connection 620 where adjacent outer wall shell portions may be attached to each other (i.e., to secure the overlap). Wall overlap connection 620 may include a zipper, hook-and-loop fasteners, tie-downs, grommets, or any suitable means to secure two adjacent outer wall shell portions to each other. Wall overlap seam 615 illustrates a view of two outer wall shell portions connected to each other. In this example, this may be seen at overlap 605.

Additionally, in this example, wall overlap seam 615 that connects overlap 605 utilizes at least overlay tie-downs 625. View 600 also illustrates connection point 630 which is an example of a collar 135 at or near the top of a vertical that may be used to connect upper horizontal in addition to providing a connection point for optional weighting to increase structural integrity (see sandbags 1005A-C of FIG. 10).

Figure 7:
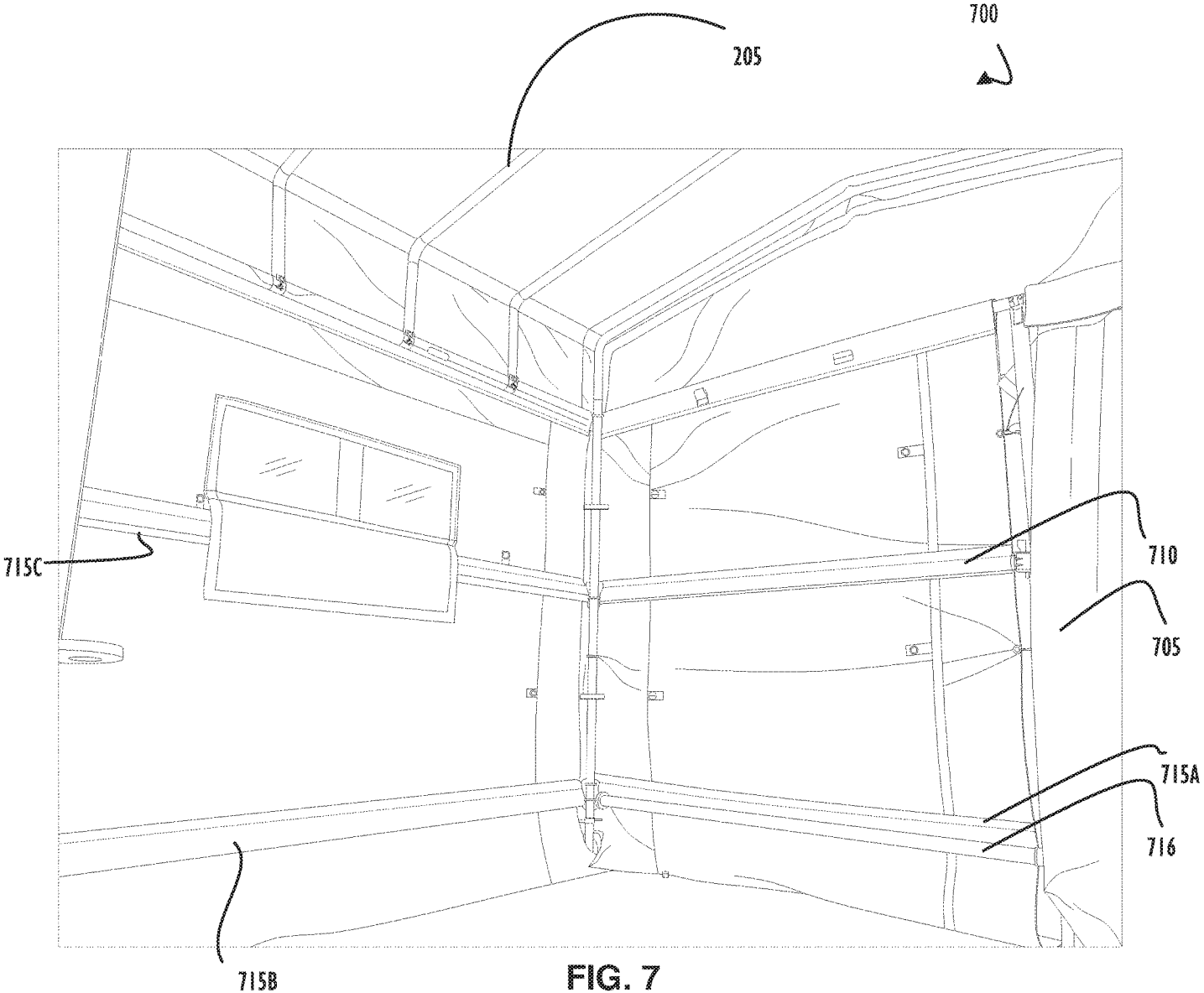
FIG. 7 illustrates an internal view of a covered corner portion including an internal view of sleeve folds and several scaffold cross-beams (horizontal supports) with some cross-beams inside of respective sleeve folds and one example of a horizontal support external to its sleeve fold (for illustration only not intended for an operational implementation), according to one or more disclosed implementations.

FIG. 7 illustrates an internal view of a covered corner portion including an internal view of sleeve folds and several scaffold cross-beams (horizontal supports) with some horizontals inside of respective sleeve folds (horizontals not specifically visible) and one example of a horizontal support external to its sleeve fold (for illustration only not intended for an operational implementation), according to one or more disclosed implementations. View 700 has roof beams 205 at the top and attached to an upper horizontal as discussed previously. Door flap 705 is illustrated at the right side of view 700. Element 710 illustrates a sleeve fold with a horizontal (not visible) internal to that sleeve fold.

As discussed herein, the sleeve folds of the outer shell portions provide secure attachments of the outer shell to the structural components of a modular canopy structure. Empty sleeve fold 715A is illustrated directly adjacent to lower horizontal 716 that is outside of sleeve fold 715A for illustration purposes only. Sleeve fold 715B is illustrated in its operational configuration and includes a horizontal support that is obstructed from view by sleeve fold 7156. Sleeve folds may be formed using strong flame retardant thread by creating a flap with a hollow interior for insertion therethrough of a horizontal. In this manner the outer shell portions of side walls are integrated with the structural integrity provided by the scaffolding material and result in a very secure connection of the overlaid fabric shell to the modular canopy structure. Sleeve fold 715C is another example that is provided at a mid-horizontal directly below a window opening in a side wall.

Figure 8:
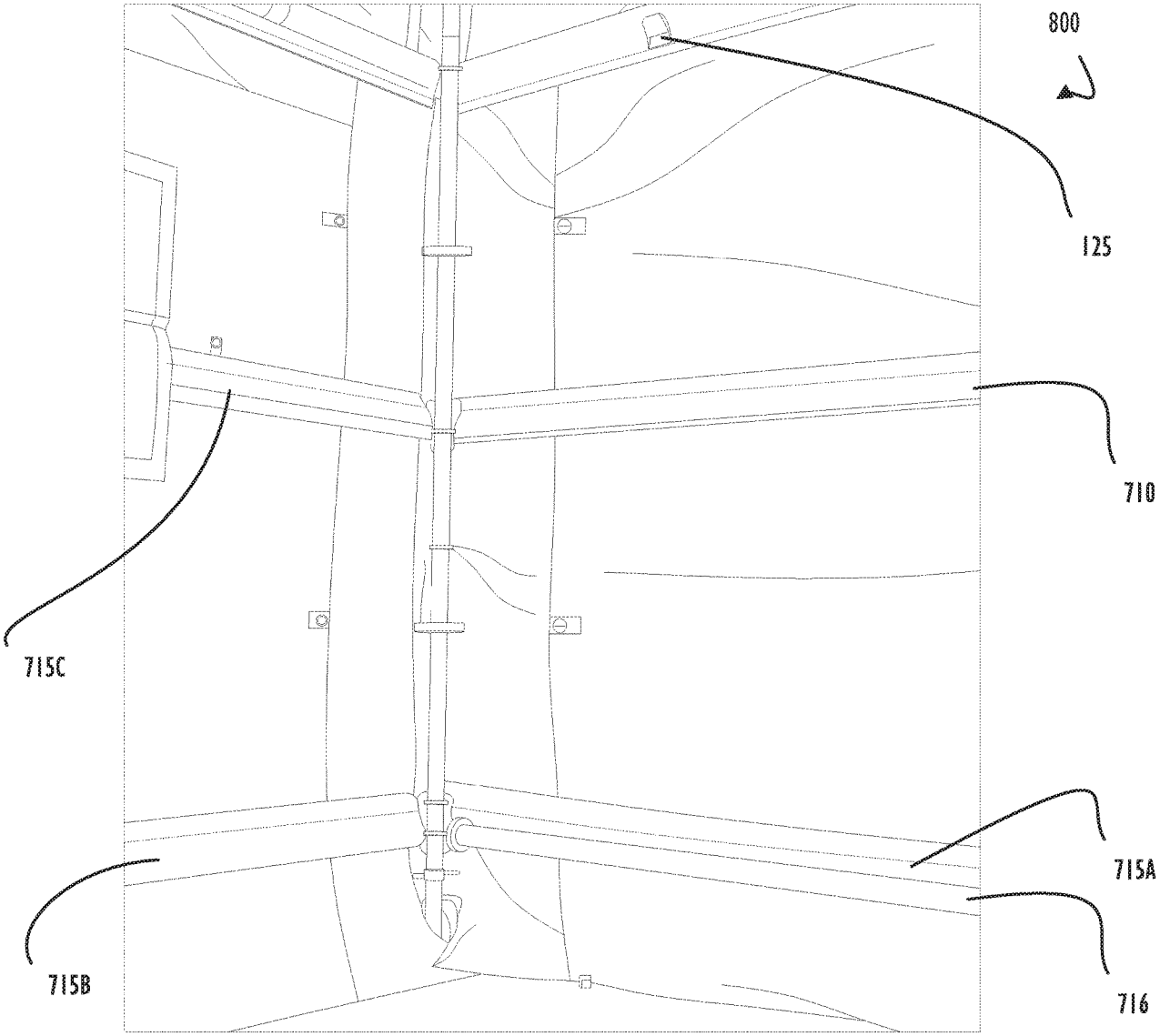
FIG. 8 illustrates a close-up view of a portion of the corner of FIG. 7, according to one or more disclosed implementations.

FIG. 8 illustrates a close up view 800 of a portion of the corner of FIG. 7 to further illustrate sleeve fold 715A-C and horizontal 716 outside of its sleeve fold (i.e., sleeve fold 715A). View 800 also provides an additional example of access flap 125.

Figure 9:
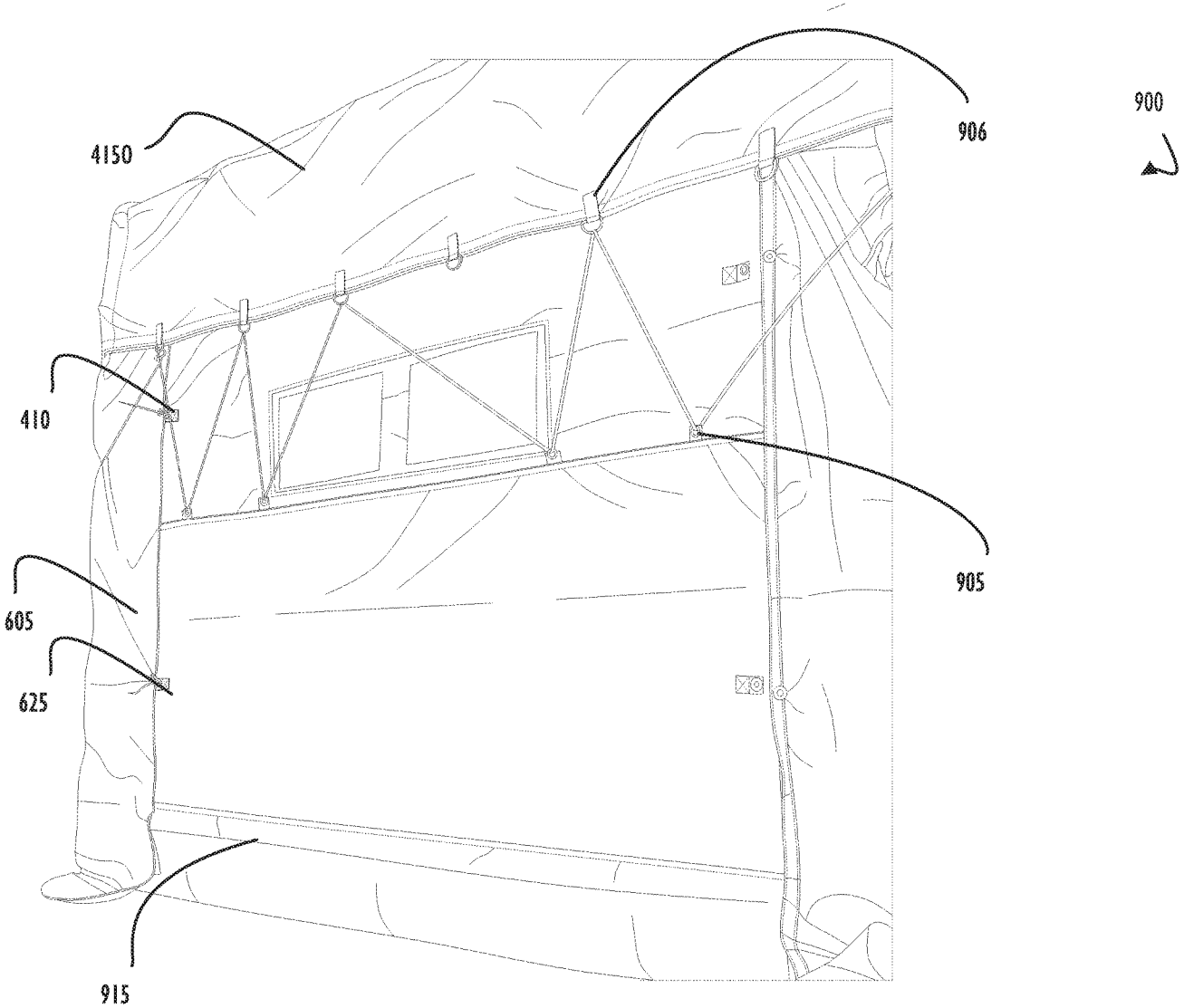
FIG. 9 illustrates another external view of a plurality of outer shell portions overlapped to form an exterior of a modular canopy structure, according to one or more disclosed implementations.

Referring now to FIG. 9, view 900 illustrates another external view of a plurality of outer shell portions overlapped to form an exterior of a modular canopy structure, according to one or more disclosed implementations. In view 900, overlaps 605 are illustrated on the right hand side and left hand side. Each of overlaps 605 may be attached using an overlay tie-down 625. Also illustrated are strap connectors 906 that allow tie-downs 410 to connect to side walls via grommets 905. Element 915 illustrates another external view of a sleeve fold that may appear as a seam within a side wall outer shell portion when viewed externally to the modular canopy structure. Roof overlap 4150 (outside perspective) is secured via tie-downs 410.

Figure 10:
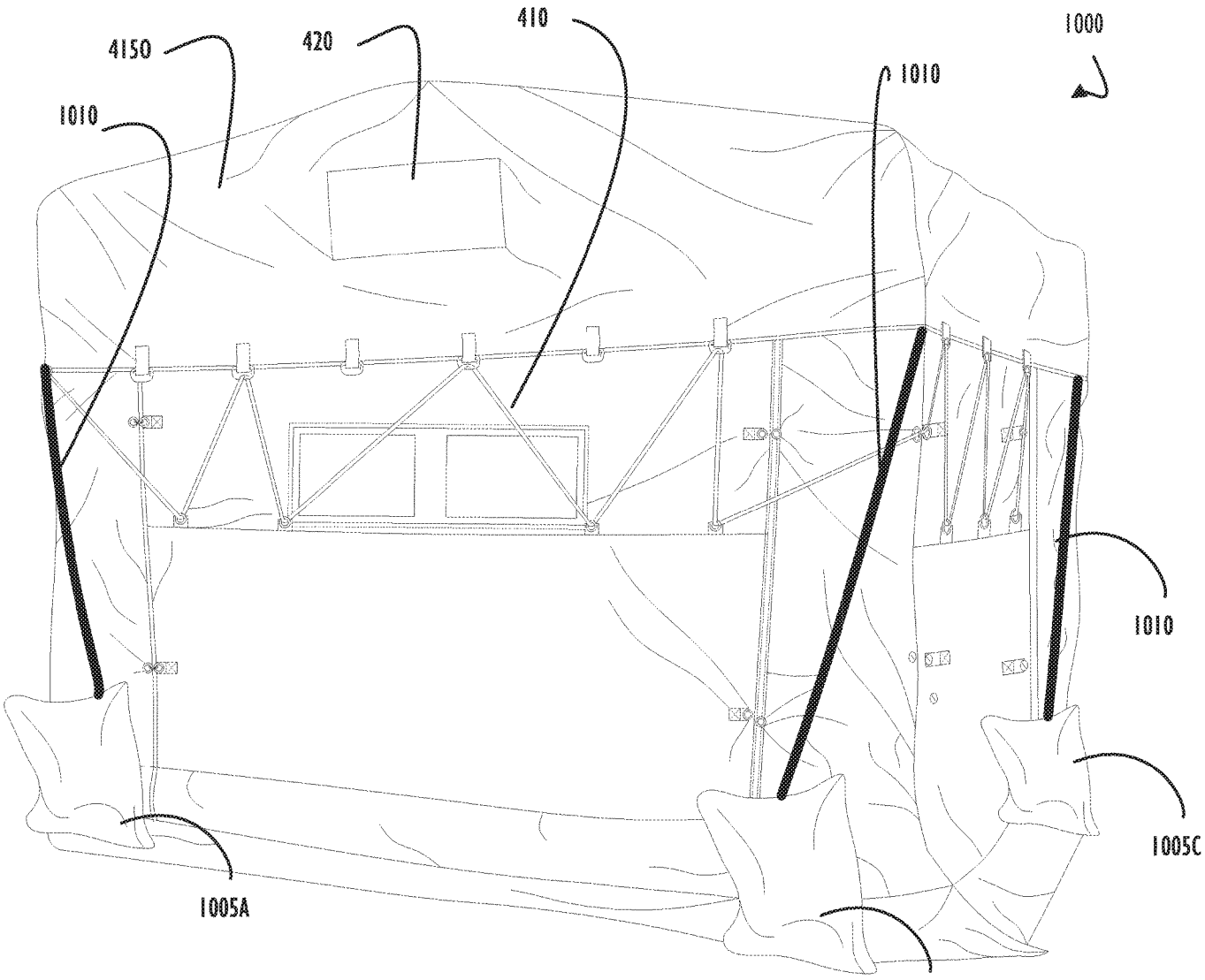
FIG. 10 illustrates another external view of a constructed and covered modular canopy structure that includes structural support weights (e.g., sandbags as weighted stabilizers) at corners of the structure, according to one or more disclosed implementations.

Referring now to FIG. 10 another external view 1000 is illustrated. View 1000 shows portions of a fully constructed and covered modular canopy structure. The modular canopy structure in view 1000 includes structural support weights (e.g., sandbags 1005A-C that may be implemented as weighted stabilizers) at respective corners of the structure, according to one or more disclosed implementations. In some cases, weighted stabilizers may be used at locations other than (or in addition to) corners of the structure. The number of, and position of, weighted stabilizers may be determined based on environmental expectations (e.g., amount of wind) in combination with mechanical considerations such as the overall size of the modular canopy structure. Roof vent 420 is shown as part of roof overlay 4150. Tie-downs 410 are again illustrated. Each of sandbags 1005A, 10056, and 1005C are connected to a vertical via a respective instance of a connection cord 1010. Although it may appear in view 1000 that connection cord 1010 is not tight, the tightness of that cord may be adjustable. In some cases, a support weight may hang just at or above the ground without being in contact with the ground so as to maintain its most effective supporting weight. Connection cord 1010 may also have elastic properties and be adjustable with respect to providing interaction between its corresponding support weight and the vertical to which it is attached.

FIG. 11 illustrates view 1100 showing a roof beam 205 and scaffolding connector 1120 of the roof-beam, according to one or more disclosed implementations. As mentioned above, scaffolding connector 1120 may be a spigot adapter clamp as illustrated by element 305 of FIG. 3. Construction of roof beams 205 may be a determining factor in the dimensions of a modular canopy structure as disclosed herein. That is, a set of roof beams 205 may be fabricated to meet specifications of a pre-determined size and shape of a modular canopy that is otherwise largely constructed of off the shelf scaffolding components. Roof beams 205 may include a number of roof verticals 1115, roof angle bends 1110, and roof pitch angle bends 1105 or roof pitch angle brackets 1106 (that become part of a roof beam 205). Fabrication of roof beams 205 may include welding together of roof sections or use of a roof section connector 1125. In any case, disclosed roof beams are meant to easily connect to traditional scaffolding components to allow maximum flexibility in construction of the disclosed modular canopy structure.

Figure 12:
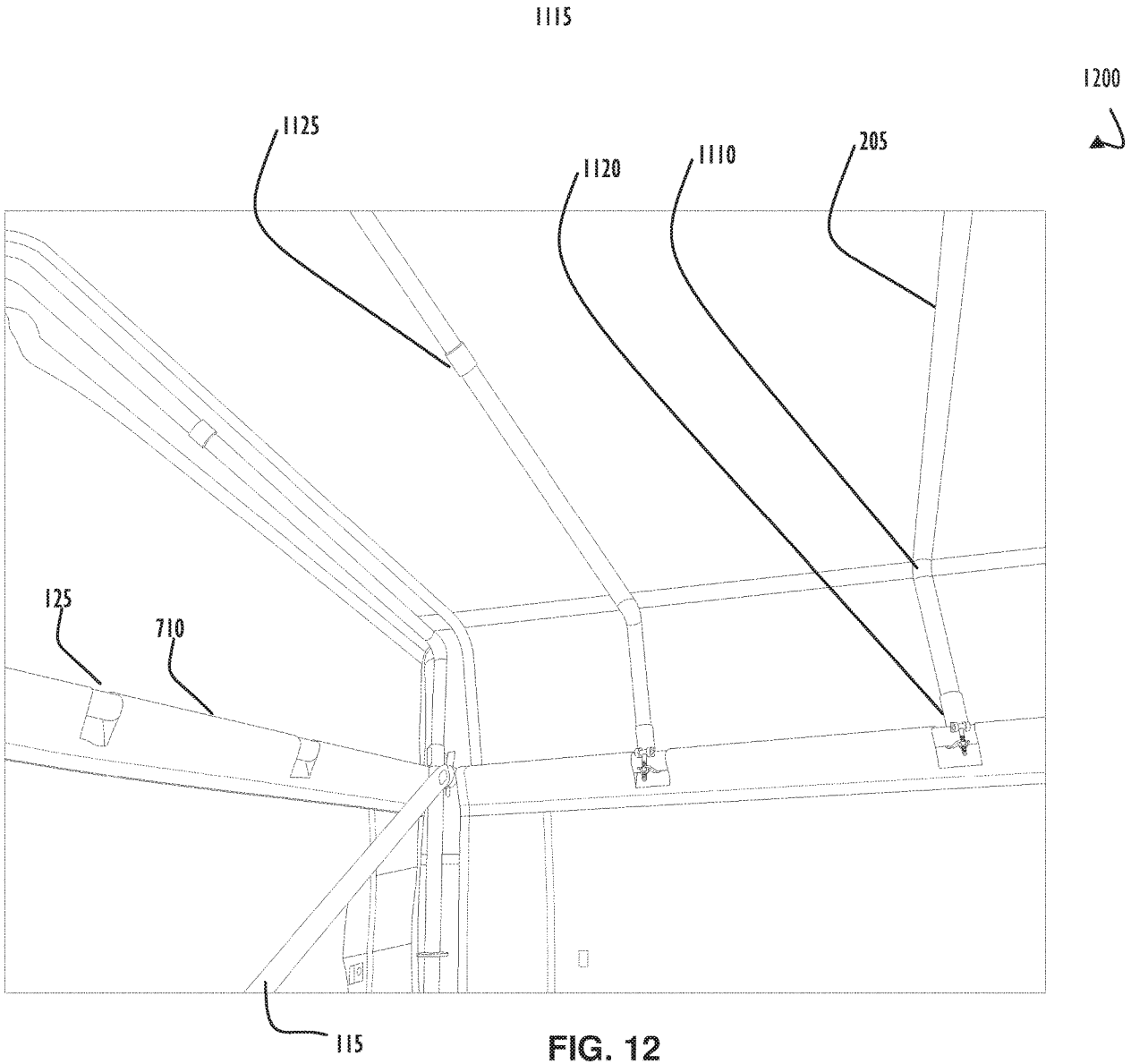
FIG. 12 illustrates an internal view of a corner roof portion of a modular canopy structure, according to one or more disclosed implementations.

FIG. 12 illustrates an internal view 1200 of a corner roof portion of a modular canopy structure, according to one or more disclosed implementations. View 1200 repeats some components already explained and illustrates how roof angle bends 1110 may form an edge for a roof outer shell portion.

Figure 13:
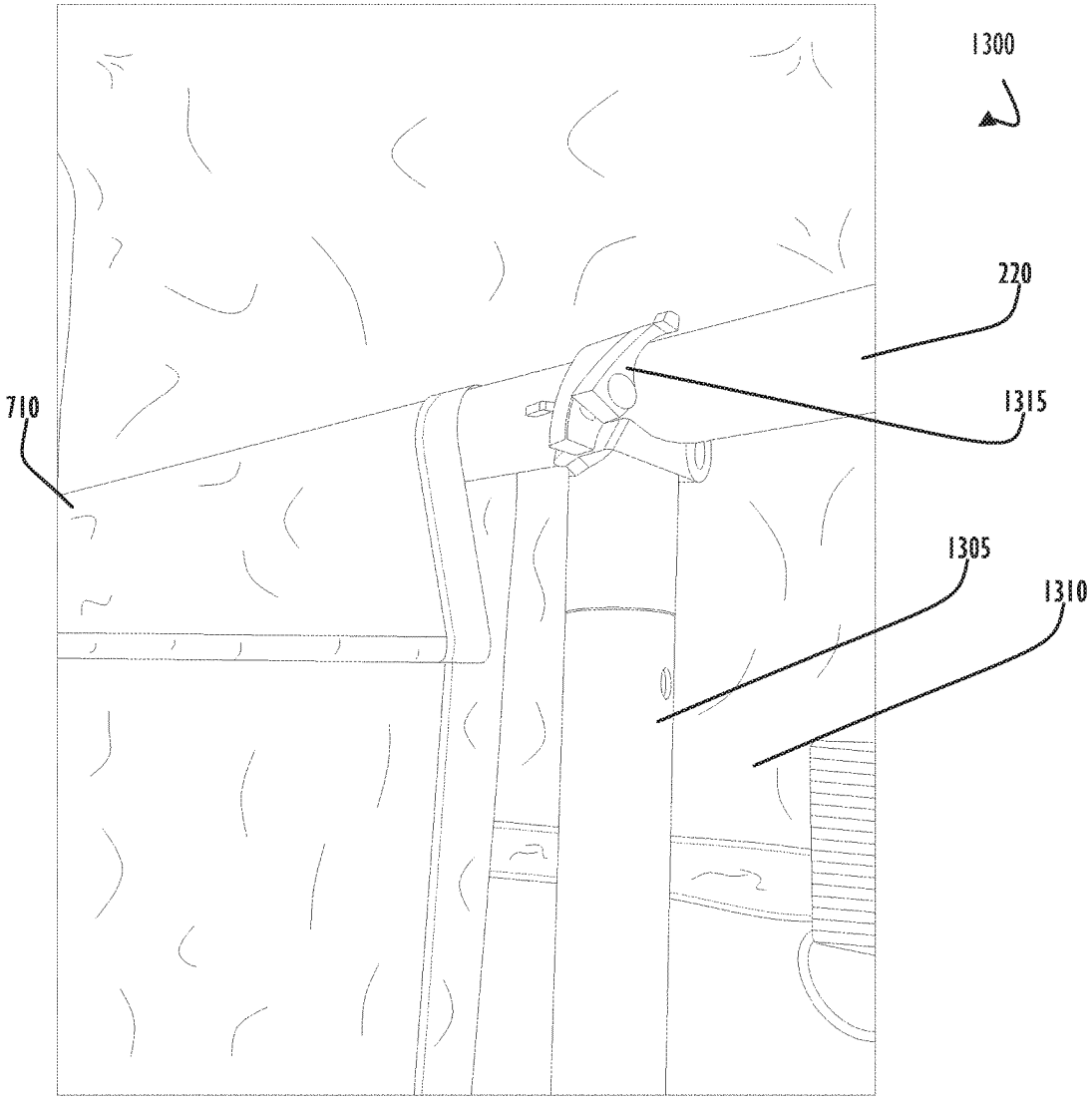
FIG. 13 illustrates a close-up view of a door corner frame portion where a door vertical connects to an upper horizontal support member, according to one or more disclosed implementations.

FIG. 13 illustrates a close-up view 1300 of a door corner frame portion where a door vertical 1305 connects to an upper horizontal support member 220, according to one or more disclosed implementations. In view 1300, door flap 1310 is illustrated on the right hand side and is formed, in part, by door vertical 1305 that utilizes an inverted (with respect to roof beam connectors) version of a spigot adapter clamp 1315.

Figure 14:
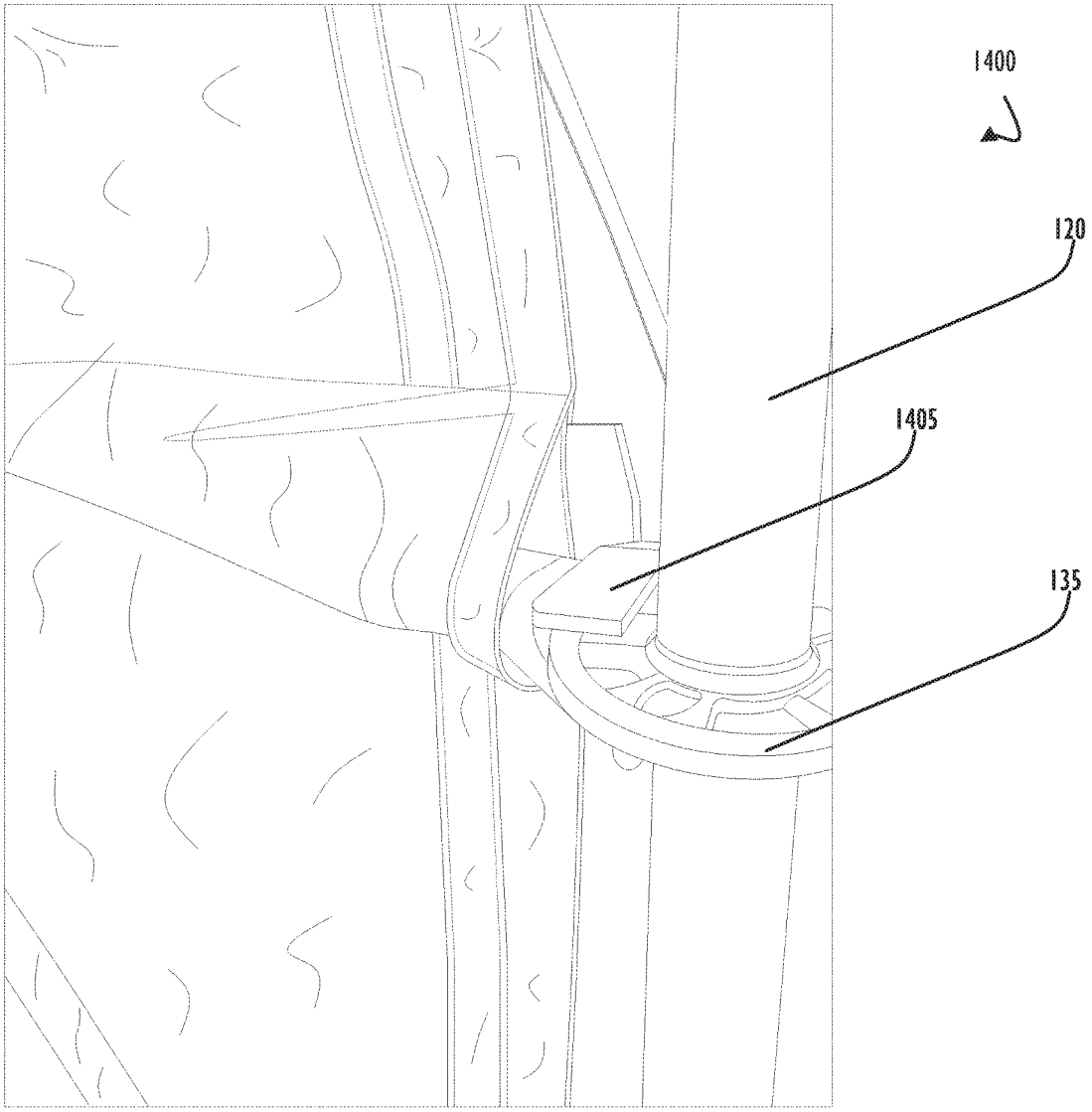
FIG. 14 illustrates a close-up view of an inside fold, corresponding horizontal support member, and a connection point between the horizontal and a vertical support member, according to one or more disclosed implementations.

FIG. 14 illustrates a close-up view 1400 of an inside sleeve fold, corresponding horizontal support member, and a connection point 1405 between the horizontal and vertical support member 120, according to one or more disclosed implementations. As explained above, collar 135 may be used to form a connection between horizontals and verticals.

Figure 15:
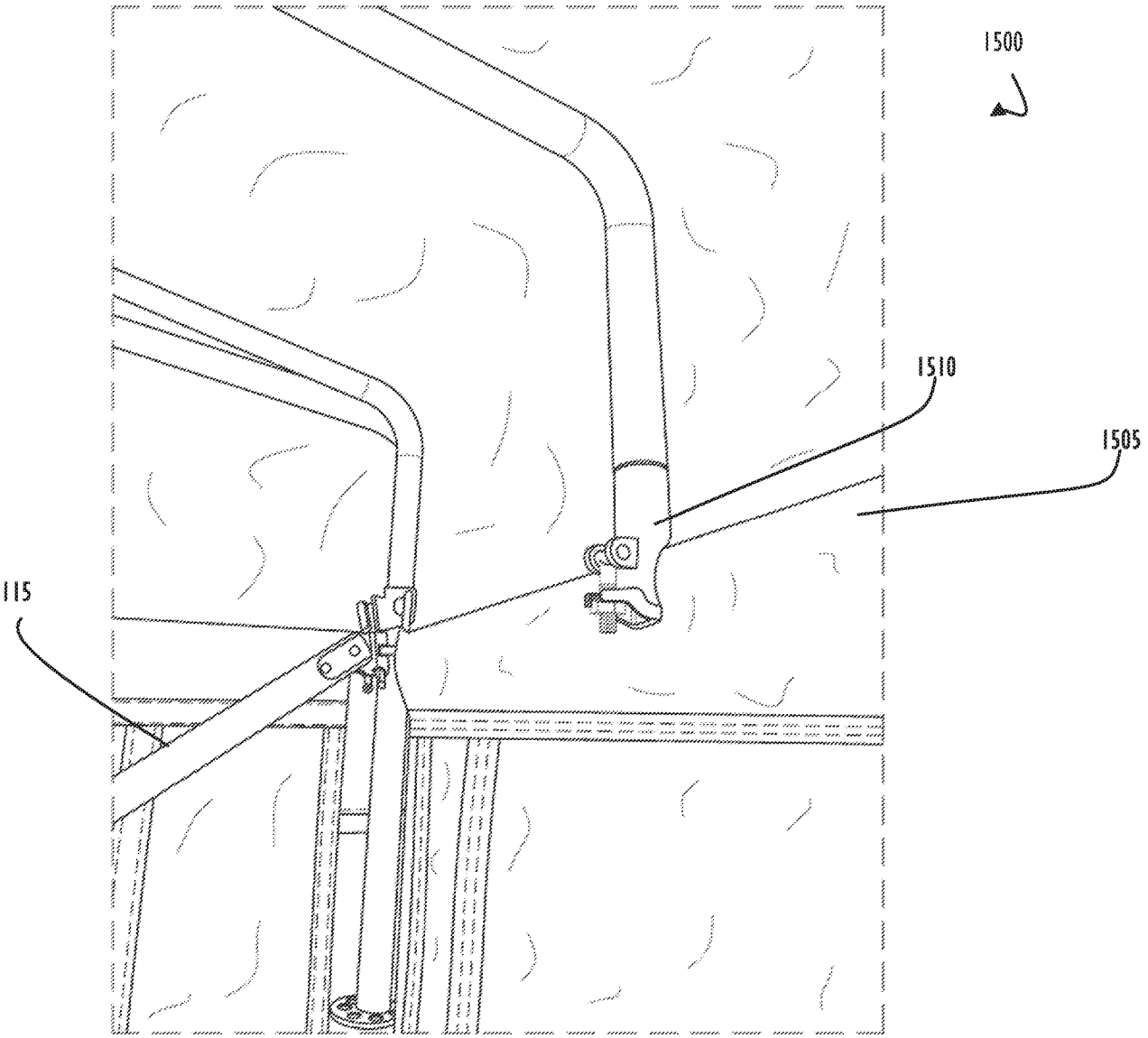
FIG. 15 illustrates a close-up view of an upper horizontal and connections for other support structures (e.g., diagonal support and roof beam), according to one or more disclosed implementations.

FIG. 15 illustrates a close-up view 1500 of an upper horizontal 220 that is inside a sleeve fold at point 1505 and connections for other support structures (e.g., diagonal support 115 and roof beam 205), according to one or more disclosed implementations. Roof beam 205 attaches to upper horizontal 220 at 1510 which represents an instance of spigot adapter clamp 305.

Figure 16:
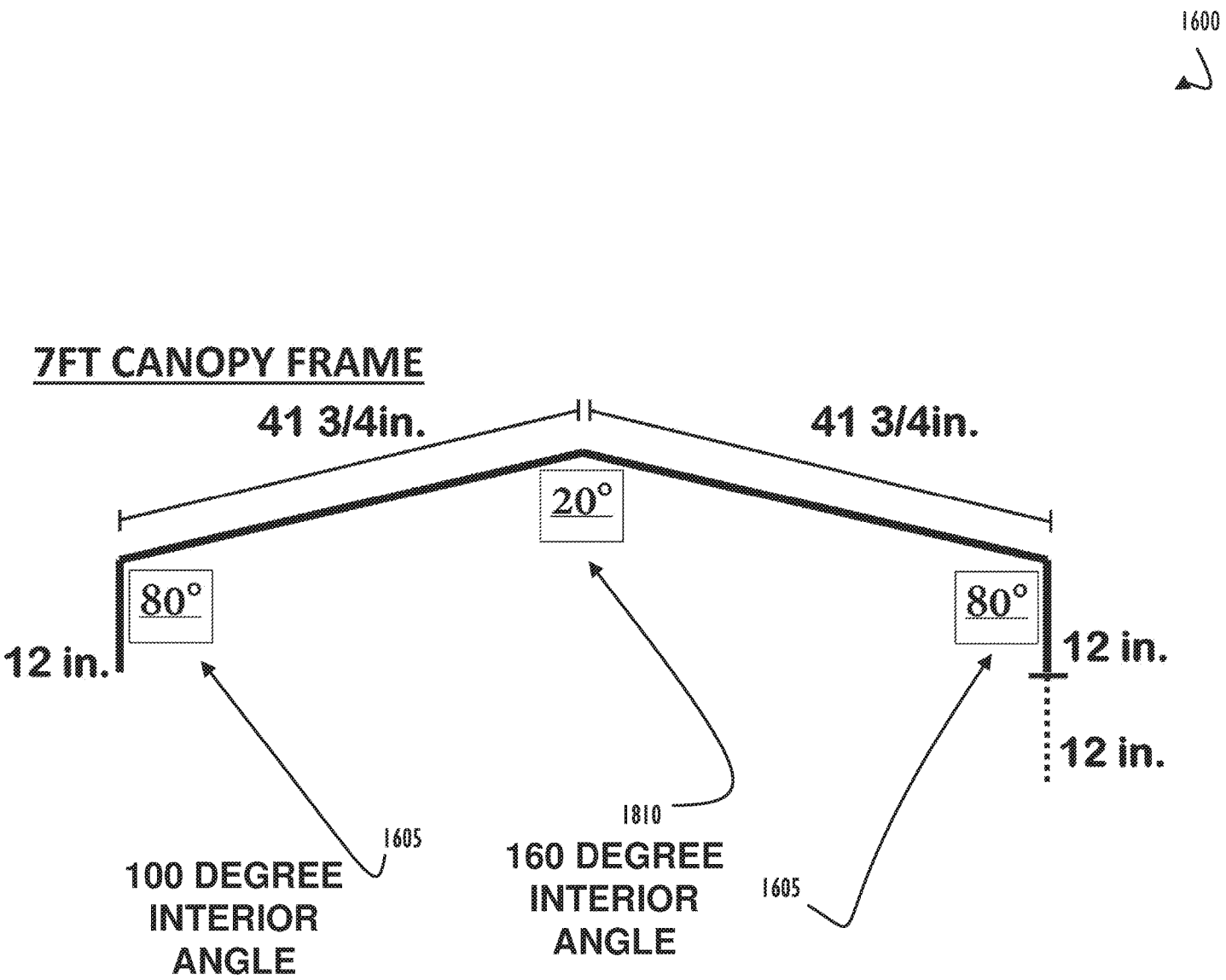
FIG. 16 illustrates an example seven foot canopy frame, according to one or more disclosed implementations.

FIG. 16 illustrates an example 1600 of a seven foot canopy frame, according to one or more disclosed implementations. As illustrated, each roof beam may have an angle of 80 degrees at each end and create a pitch based on a top angle of 20 degrees down relative to 180 degrees (i.e., an interior angle at the apex of each roof beam 205 of 160 degrees) from an interior side of the intended roof structure. At each corner there is shown an 80 degree exterior angle and an adjacent 100 degree interior angle (on the inside) to cause ends of the roof beams 205 to be oriented vertically and attach to verticals as described above.

Figure 17:
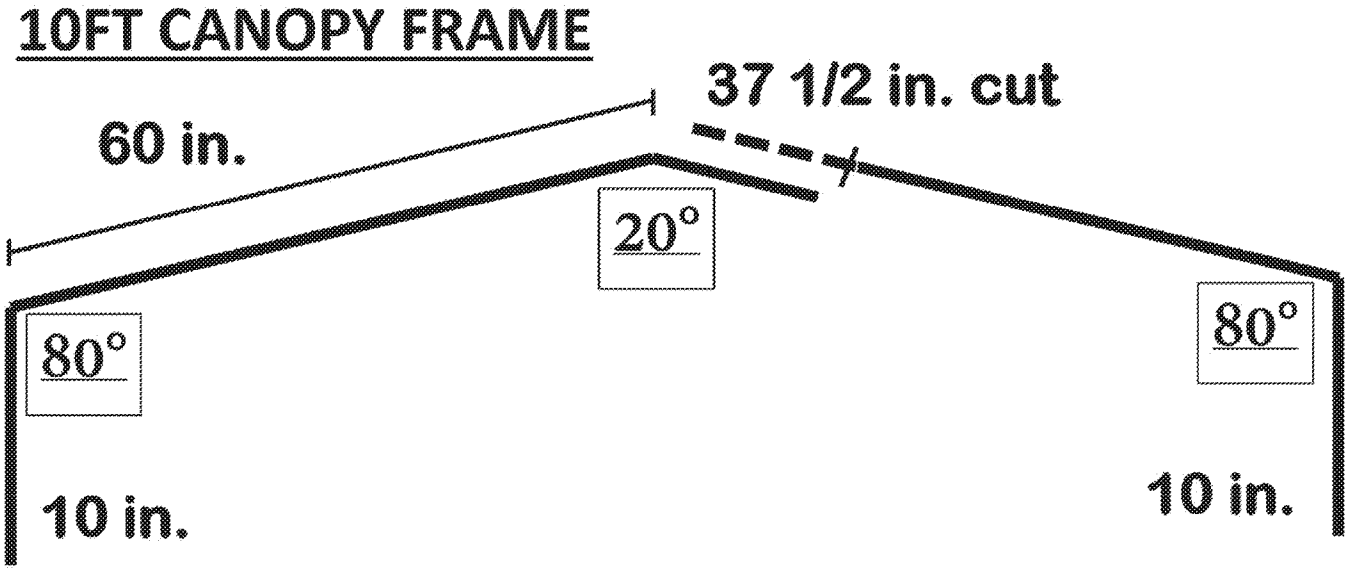
FIG. 17 illustrates an example ten foot canopy frame, according to one or more disclosed implementations.

FIG. 17 illustrates an example 1700 ten foot canopy frame, according to one or more disclosed implementations. Example 1700 includes similar angles to that of example 1600 but has different lengths of straight segments to allow for a 10 foot canopy.

Figure 18:
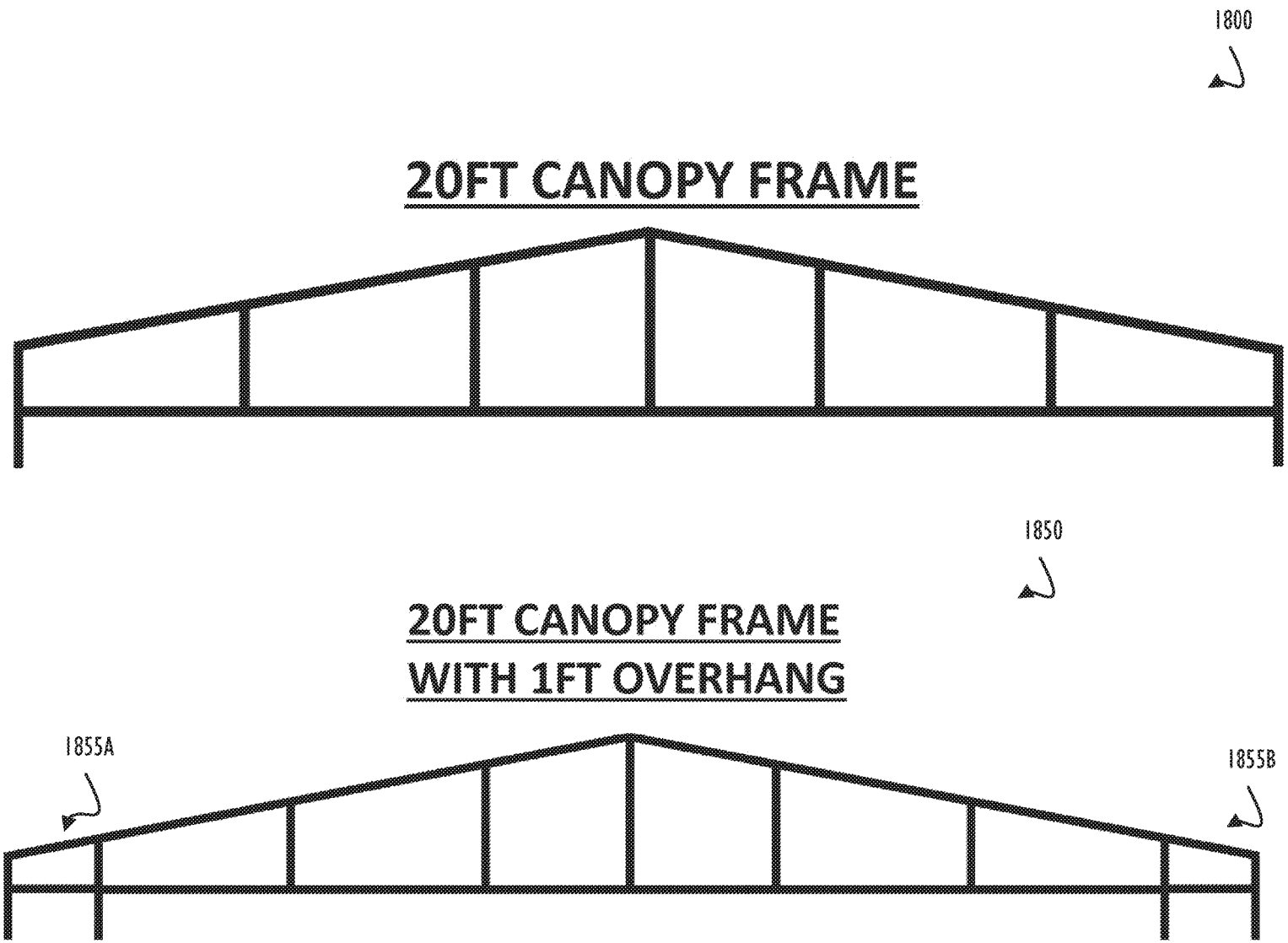
FIG. 18 illustrates two examples of twenty foot canopy frames (one with and one without an overhang), according to one or more disclosed implementations.

FIG. 18 illustrates two examples of twenty foot canopy frames, according to one or more disclosed implementations. In example 1800 the 20 foot canopy frame consists of 6 segments and does not include any overhang. In example 1850 the 20 foot canopy includes an additional 2 segments to create a 1 foot overhang on either side as illustrated by overhang segments 1855A and 1855B.

The above views and examples are not exhaustive of the combinations and permutations of modular canopy structures that may be built in accordance with disclosed techniques.

Different implementations are possible. In one example, a modular canopy structure in accordance with this disclosure may include: four walls constructed using a plurality of scaffolding support units, the scaffolding support units providing multiple vertical support pieces and multiple horizontal support pieces, each of the vertical support pieces and horizontal support pieces interconnected via a union at a plurality of intersection points, and the scaffolding support units comprising sections manufactured to conform to an industrial standard for scaffolding; a plurality of roof beams to form a roof portion, each of the plurality of roof beams including a first scaffold interconnect at one end of the each roof beam and a second scaffold interconnect at a second end of the each roof beam, the each roof beam spanning above and connected to a first upper horizontal mounted above the multiple vertical support pieces, at a first wall of the four walls and a second upper horizontal mounted above the multiple vertical support pieces, at a second wall of the four walls, the first wall and the second wall providing opposing walls of the modular canopy structure; and an outer shell encasing the four walls and the roof portion, the outer shell comprising multiple overlapping shell pieces to surround a perimeter created by the four walls and cover a top of the roof structure including the roof portion.

The above example may be extended to include a weighted object connected using a tie-down to add structural integrity to a vertical support piece at a corner between two of the four walls. The above example may be extended to include the tie-down being made of a rope, chain, line, cord, or bungy type material. The above example may be extended, wherein the weighted object comprises a sandbag.

Any of the above examples may be extended, wherein the four walls form a rectangle with two of the four walls having a first length and a different two of the four walls having a second length, wherein the first length and the second length are different or wherein the four walls form a square, wherein each of the four walls has the same length.

Any of the above examples may be extended, wherein each of the plurality of roof beams includes an arch to provide a slope for the outer shell portion overlaying the roof portion.

Any of the above examples may be extended, wherein the multiple overlapping shell pieces include: a first shell piece to cover a first wall and overlap with a portion of a second wall and a fourth wall; a second shell piece to cover the second wall and overlap with a portion of the first wall and a third wall; a third shell piece to cover the third wall and overlap with a portion of the second wall and the fourth wall; a fourth shell piece to cover the fourth wall and overlap with a portion of the third wall and the fourth wall; and a fifth shell piece to cover the roof portion and overlap with a portion of the first wall, the second wall, the third wall, and the fourth wall, wherein the four walls include the first wall, the second wall, the third wall, and the fourth wall.

Any of the above examples may be extended to include a plurality of tie-downs from the fifth shell piece to each of the four walls.

Any of the above examples may be extended, wherein each of the plurality of tie-downs from the fifth shell piece to each of the four walls attaches to a grommet associated with a sleeve fold in an associated one of the four walls.

Any of the above examples may be extended to include a plurality of tie-downs from the fifth shell piece to multiple weighted objects to provide structural support and weighted stress to the roof portion, each of the multiple weighted objects positioned in close proximity to the ground.

Any of the above examples may be extended, wherein each of the multiple weighted objects are at least partially touching the ground.

Any of the above examples may be extended, wherein at least one of the four walls includes a door opening to allow entry and exit from the modular canopy structure.

Any of the above examples may be extended, wherein at least one of the four walls includes a window to allow ventilation between an interior of the modular canopy structure and an exterior space.

Any of the above examples may be extended, wherein all of the multiple overlapping shell pieces are constructed of flame retardant material.

Certain terms have been used throughout this description and claims to refer to particular system components. As one skilled in the art will appreciate, different parties may refer to a component by different names. This document does not intend to distinguish between components that differ in name but not function. In this disclosure and claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first component couples to a second component, that coupling may be through a direct connection or through an indirect connection via other components and connections. In this disclosure a direct connection will be referenced as a "connection" rather than a coupling. The recitation "based on" is intended to mean "based at least in part on." Therefore, if X is based on Y, X may be a function of Y and any number of other factors.

The above discussion is meant to be illustrative of the principles and various implementations of the present disclosure. Numerous variations and modifications will become apparent to those skilled in the art once the above disclosure is fully appreciated. It is intended that the following claims be interpreted to embrace all such variations and modifications.

What is claimed is:

1. A modular canopy structure comprising:

four vertical walls including a first wall, a second wall, a third wall, and a fourth wall, the first and second wall opposite each other and the third and fourth wall opposite each other, each of the four vertical walls constructed using a plurality of scaffolding support units, the scaffolding support units including multiple vertical support pieces and multiple horizontal support pieces, the vertical support pieces and horizontal support pieces interconnected at a plurality of intersection points using scaffolding interconnects, the scaffolding support units comprising sections, the sections and the scaffolding interconnects manufactured to conform to an industrial standard for scaffolding;

a plurality of roof beams to form a roof portion positioned above each of the four vertical walls, each of the plurality of roof beams including a first scaffold interconnect spigot clamp at one end of the each roof beam and a second scaffold interconnect spigot clamp at a second end of the each roof beam, the each roof beam concurrently connected to both the first wall and the second wall via respective spigot clamps attached to a first upper horizontal support piece of the first wall and a second upper horizontal support piece of the second wall; and an outer shell encasing the four vertical walls and the roof portion, the outer shell comprising multiple overlapping shell pieces, wherein at least some of the multiple overlapping shell pieces concurrently surround a perimeter created by the four vertical walls and cover a top of a roof structure including the roof portion.

2. The modular canopy structure of claim 1, further comprising:

a tie-down; and a weighted object connected using the tie-down to add structural integrity to a vertical support piece at a corner vertical between two of the four vertical walls.

3. The modular canopy structure of claim 2, wherein the tie-down comprises a rope, chain, line, cord, or bungy-type material.

4. The modular canopy structure of claim 2, wherein the weighted object comprises a sandbag.

5. The modular canopy structure of claim 1, wherein the four vertical walls form a rectangle with two of the four vertical walls having a first length and a different two of the four vertical walls having a second length, wherein the first length and the second length are different.

6. The modular canopy structure of claim 1, wherein the four vertical walls form a square, wherein each of the four vertical walls has the same length.

7. The modular canopy structure of claim 1, wherein each of the plurality of roof beams includes is arched to provide a slope as a roof pitch formed using portions of the multiple overlapping shell pieces that overlay the roof portion.

8. The modular canopy structure of claim 1, wherein:

the multiple overlapping shell pieces include:

a first shell piece to cover the first wall and overlap with a portion of the second wall and the fourth wall;

a second shell piece to cover the second wall and overlap with a portion of the first wall and the third wall;

a third shell piece to cover the third wall and overlap with a portion of the second wall and the fourth wall;

a fourth shell piece to cover the fourth wall and overlap with a portion of the third wall and the fourth wall; and a fifth shell piece to cover the roof portion and overlap with a portion of the first wall, the second wall, the third wall, and the fourth wall.

9. The modular canopy structure of claim 8, further comprising a plurality of tie-downs from the fifth shell piece to each of the four vertical walls.

10. The modular canopy structure of claim 9, wherein each of the plurality of tie-downs attaches to a grommet associated with a sleeve fold in an associated one of the four vertical walls.

11. The modular canopy structure of claim 8, further comprising a plurality of tie-downs from the fifth shell piece to multiple weighted objects to provide structural support and weighted stress to the roof portion, each of the weighted objects positioned in close proximity to the ground.

12. The modular canopy structure of claim 11, wherein each of the multiple weighted objects is at least partially touching the ground.

13. The modular canopy structure of claim 8, wherein at least one outer shell piece covering one of the four vertical walls includes a window to allow ventilation between an interior of the modular canopy structure and an space exterior to the modular canopy structure.

14. The modular canopy structure of claim 8, wherein all of the multiple overlapping shell pieces are constructed of a flame retardant material.

15. The modular canopy structure of claim 1, wherein at least one of the four vertical walls includes a door opening to allow entry and exit from the modular canopy structure.

16. The modular canopy structure of claim 1, wherein the modular canopy structure is a seven foot canopy.

17. The modular canopy structure of claim 1, wherein the modular canopy structure is a twenty foot canopy.

18. The modular canopy structure of claim 1, wherein the modular canopy structure is a seven foot canopy with a 1 foot overhang on two opposing sides formed by roof beams extending beyond two of the four vertical walls.

19. The modular canopy structure of claim 1, wherein the modular canopy structure is a twenty foot canopy with a 1 foot overhang on two opposing sides formed by roof beams extending beyond two of the four vertical walls.

20. The modular canopy structure of claim 19, wherein the 1 foot overhang extends over a door opening.

* * * * *